US012486005B2

(12) United States Patent
Rosen

(10) Patent No.: US 12,486,005 B2
(45) Date of Patent: Dec. 2, 2025

(54) WATER SPORT DEVICE

(71) Applicant: ROSEN SWISS AG, Stans (CH)

(72) Inventor: Hermann Rosen, Kastanienbaum (CH)

(73) Assignee: ROSENXT HOLDING AG, Stans (CH)

( * ) Notice: Subject to any disclaimer, the term of this patent is extended or adjusted under 35 U.S.C. 154(b) by 723 days.

(21) Appl. No.: 17/755,567

(22) PCT Filed: Nov. 2, 2020

(86) PCT No.: PCT/EP2020/080711
§ 371 (c)(1),
(2) Date: May 2, 2022

(87) PCT Pub. No.: WO2021/084135
PCT Pub. Date: May 6, 2021

(65) Prior Publication Data

US 2022/0363352 A1 Nov. 17, 2022

(30) Foreign Application Priority Data

Nov. 1, 2019 (DE) ..... 102019129569.6

(51) Int. Cl.
*B63B 32/66* (2020.01)
*B63B 32/10* (2020.01)

(52) U.S. Cl.
CPC ..... *B63B 32/66* (2020.02); *B63B 32/10* (2020.02)

(58) Field of Classification Search
CPC ..... B63B 32/10; B63B 32/66
See application file for complete search history.

(56) References Cited

U.S. PATENT DOCUMENTS 3,099,239 A * 7/1963 Von Schertel ..... B63B 1/30 114/282
3,802,369 A 4/1974 Ishimoto
(Continued)

FOREIGN PATENT DOCUMENTS

CN 208715431 U 4/2019
CN 208760860 U * 4/2019 ..... B63B 32/64
(Continued)

*Primary Examiner* — S. Joseph Morano
*Assistant Examiner* — Jovon E Hayes
(74) *Attorney, Agent, or Firm* — Husch Blackwell LLP

(57) ABSTRACT

A retaining device of a water sport device has a drive, which is preferably designed as an electromechanical or electro-pneumatic drive and via which the foil device can be transitioned from a resting and/or starting position into the operating position and/or from the operating position into the resting and/or starting position. The actuation can take place manually by a person operating the water sport device. The water sport device may already be lowered into knee-deep water near the shore or beach, for example, and guided or driven there in the direction of deeper water. As soon as sufficiently deep water has been reached, the foil device can be transitioned into the operating position, which is at a greater distance from the floating body, by means of the drive. This process can take place automatically when a specifiable or set water depth has been reached or by the release on the part of the person using the water sport device.

24 Claims, 5 Drawing Sheets

(56) References Cited

U.S. PATENT DOCUMENTS

| | | | | |
|---|---|---|---|---|
| 6,789,489 | B1 * | 9/2004 | Phipps | B63H 9/069 114/280 |
| 10,926,837 | B2 * | 2/2021 | Pritchard | B63B 1/248 |
| 11,577,806 | B2 * | 2/2023 | Rozand | B63B 1/30 |
| 2005/0109258 | A1 * | 5/2005 | Smith | B63B 1/28 114/274 |
| 2018/0072383 | A1 * | 3/2018 | Montague | B63B 32/64 |
| 2019/0054980 | A1 * | 2/2019 | Dombois | B63B 1/286 |
| 2020/0079479 | A1 * | 3/2020 | Derrah | B63H 1/16 |

FOREIGN PATENT DOCUMENTS

| | | | |
|---|---|---|---|
| DE | 3425912 | A1 | 2/1985 |
| DE | 4300118 | A1 | 7/1994 |
| DE | 102015103553 | A1 | 9/2016 |
| EP | 0616584 | B1 | 3/1997 |

* cited by examiner

WATER SPORT DEVICE

CROSS REFERENCE

This application claims priority to PCT Application No. PCT/EP2020/080711, filed Nov. 2, 2020, which itself claims priority to German Patent Application No. 10 2019 129569.6, filed Nov. 1, 2019, the entirety of both of which are hereby incorporated by reference.

FIELD OF THE INVENTION

The present invention relates to a water sport device, in particular a foilboard, having a floating body, preferably in the form of a floating board, and a foil device, which is secured to the floating body by means of a retaining device, wherein the foil device arranged on a link of the retaining device has at least one, preferably at least two foils and the foil device can be transitioned from a resting and/or starting position close to the floating body into an operating position below the floating body via the retaining device, wherein the floating body in the operating position and during a forward movement can be transitioned into a position in which it is separated from the water surface due to uplift produced by the foil device.

Such a water sport device is designed in particular as a foilboard, and the floating body is designed in particular as a floating board. The at least one foil device has in particular at least two foils. Such water sport devices generally serve for moving persons over water who for this purpose situate themselves on the side of the floating body facing away from the foil device. During the movement, the foil device is generally situated below the water surface.

BACKGROUND OF THE INVENTION

DE 10 2015 103 553 A1 discloses a water sport device having a foil arrangement, which can also be designated a foil and can fold back opposite the direction of travel in the event of an underwater contact so as to avoid damage. Further, US 2018/0072383 A1 discloses a foil arrangement which can be transitioned from a first operating position into a further operating position by an adjustable angle of the connection strut between the floating body and the propulsion device. Both water sport devices of the prior art require sufficiently deep waters for their use, since otherwise the foil arrangement will touch the bottom and either become damaged or folded back. For transport, the foil device is either disassembled or the water sport device must be transported with the foil device projecting generally by up to one meter.

BRIEF SUMMARY OF THE INVENTION

The object of the invention is to provide a water sport device which is easier to handle while exhibiting good reliability.

According to the invention, the retaining device has a drive, which is preferably designed as an electromechanical or electropneumatic drive and via which the foil device can be transitioned from a resting and/or starting position into the operating position and/or from the operating position into the resting and/or starting position, in particular is retractable and extendable and/or foldable. The actuation can take place here manually by a person operating the water sport device, with the advantage that the water sport device is easier to transport compared to conventional foilboards in the resting or starting position of the foil device close to or at least partially in the floating body. In particular, the water sport device can already be lowered into knee-deep water near the shore or beach, for example, and guided or driven there in the direction of deeper water. As soon as sufficiently deep water has been reached, the foil device can be transitioned into the operating position, which is at a greater distance from the floating body, by means of the drive. This process can take place automatically when a specifiable or set water depth has been reached or by the release on the part of the person using the water sport device.

The transition into the resting and/or starting position can also take place by adopting intermediate positions in which the foil arrangement is not as close to the floating body as in the resting and/or starting position. To trigger the actuation, the drive is equipped with a control unit that receives a signal triggered by a user or automatically generates such a signal, e.g., on the basis of sensor information, and transmits a control signal to the drive.

The drive is preferably designed as an electromechanical or electropneumatic drive. The drive energy is preferably provided by a motor, electromechanically, or electropneumatically. An electropneumatic drive has electrically powered components for adjusting pneumatic actuating elements. In particular, compressed air is controlled by electrical signals. Electromechanical drives are characterized by the generation of mechanical processes, such as rotating a shaft, using an electrically operated motor. These types of drive ensure that the water sport device is less susceptible to errors.

In particular, the drive is thus provided with an electric motor whose drive energy is used to move the foil device.

The floating body is in particular a flat, elongate body whose density is significantly below that of water. The floating body is in particular designed in such a way that, during operation, it is at any rate at least partially situated above the water surface, preferably independently of a speed of travel. During operation, the retaining device extends from the floating body to the foil device below the floating body. A lifting force generated by the foil device is transmitted to the floating body by the retaining device.

In the resting and/or starting position, the foil device is arranged closer to the floating body than in the operating position in order to make the water sport device more compact. In particular, the retaining device is folded and/or retracted in order to transition the foil device into the resting and/or starting position. In particular, the at least one, first link is pivoted by at least 20°, preferably by at least 40°, particularly preferably by at least 80°, in order to transition the foil device relative to the floating body. Preferably, in the resting and/or starting position, the foils are spaced apart from the floating body by no more than 50 cm in a side view.

The at least one link is designed in particular as a rigid strut. In particular, the link is mounted to be pivotable relative to the floating body and/or relative to the foil device. As an alternative or in addition, the at least one, first link is mounted to be movable in a translational manner, in particular displaceable, relative to the floating body and/or relative to the foil device. The foil device is in particular coupled indirectly, via other components such as links, or directly to the first link. A link, as it is referred to, is generally a movably connected and in particular articulated, but otherwise rigid, linkage component in the form of a solid or body, for example, which can be used, possibly in combination with one or more further links, to move parts of the water sport device relative to one another. The retaining device preferably has links that are pivotable in relation to one another and/or that are displaceable into or against one another and thus, for example, can be telescoped.

The foil device is preferably provided, at least in the operating position, with at least one foil, which is flat and preferably at least partially wing-shaped or fin-shaped. The width of the foil device, measured transversely to the direction of travel, is in particular at most twice as large as the width of the floating body. The foil device serves to stabilize the ride with the water sport device and to generate uplift, wherein the foil device preferably has lateral foil ends, which are angled relative to the substantially flat water surface, to enhance these effects. In order to enhance these effects, the water sport device preferably has a plurality of foils which are spaced apart from one another in the direction of travel and/or at different distances from the floating body. The foil device thus comprises at least one foil and the holder thereof and optionally a propulsion device.

The drive preferably has an energy store, in particular for storing mechanical energy, which, in the event of release, provides the energy required for retracting and extending or folding the link. For example, the store comprises a battery for storing electrical energy, a tank for storing a pressurized fluid, or in particular a mechanical energy store such as a spring. In a first embodiment of the invention, the energy store is designed to feed a motor, which initiates the transition of the foil device. In a preferred further embodiment of the invention, the energy store releases stored energy directly, without an interposed motor, as mechanical or kinetic energy for the transition. The energy store is preferably mechanically coupled to the retaining device and also directly or indirectly to a charging device such as a motor, which is designed to charge the energy store in particular while the water sport device is in use.

In particular, the energy store having at least one spring can be preloaded by means of a motor of the drive, wherein the energy stored by means of the spring can be stored without loss while the water sport device is in use. The amount of the stored energy corresponds to at least a part, preferably at least all of the energy required for transitioning the foil device from a first to a second end position. At least in the actuated state, the spring is connected to the link of the retaining device in such a way that its force can be used at least partially to align the link.

Preferably, the drive has a gearing designed in particular as a transmission gearing, via which a motor of the drive is connected to the energy store, in particular in such a way that the quotient of the time required for the folding (dividend) and the time required for the associated preloading (divisor) is less than 1. The combination of motor and gearing allows the available construction space to be better utilized, since the gearing and motor can in particular be designed coaxially and can be better arranged in the low construction height of a board-type floating body. Furthermore, the motor can be made smaller if the torque it outputs is transferred by the gearing. In particular, this combination can be used to charge and in particular preload a mechanical energy store over a specific period of time, which is capable of more quickly releasing its stored energy for moving the foil device. For example, during a ride in shallower water, the energy store can be charged over a period of one or two minutes, for example, while after that, when moving into deeper water, the foil device can be transitioned from the resting and/or starting position into the operating position within thirty seconds using the energy stored in the energy store.

A particularly compact construction is obtained if, according to a further embodiment according to the invention, the motor, gearing, energy store, and/or braking device are designed coaxially, in particular with a pivot axis of the link. The motor, gearing, and/or energy store, in particular in the form of a torsion spring, are particularly preferably arranged coaxially to one another and in a cavity of a rotary housing which is likewise pivotable and is connected directly or indirectly to a link of the retaining device for the purpose of moving the same. In this case, the torsion spring can in turn be arranged around the motor and gearing in order to utilize the available construction space. The extent thereof is significantly greater in particular in the transverse direction of a floating body that is designed as a floating board for a foilboard than in the vertical direction, and therefore a sufficiently dimensioned torsion or spiral spring, the length of which in the direction of a longitudinal central axis is in particular greater than its width, can include a comparatively narrow motor.

For the purpose of transitioning from a first position to a further position and vice versa, the energy store having at least one spring can preferably be preloaded in opposite directions by the motor or motor and gearing. According to a special embodiment of the invention, the energy store has two springs that can be loaded in particular in opposite directions and are preferably arranged on a motor or gearing shaft with freewheels that are designed in opposite directions. As a result, the motor can successively preload the two springs, which are designed in particular as torsion or spiral springs.

The retaining device preferably has an in particular electromagnetic or electromagnetically actuable braking device which blocks, releases, and/or brakes the displacement of the foil device, as a result of which the movement of the foil device takes place in a controlled manner. In particular, the braking force can be regulated or adjusted by varying an attractive force depending on the speed of the floating body and/or on the position of the foil or retaining device. For this purpose, the control unit has appropriate means for detecting a position of the foil device or the retaining device, e.g., rotary encoders or limit switches, means for controlling the braking device, e.g., an electric, electromagnetic, hydraulic, and/or pneumatic actuator, and preferably electric and/or electronic signal generators, which process the information provided by the respective sensors, in particular the speed over ground or water.

In the event of a power failure, the braking device is designed in such a way that the movement of the retaining device is blocked in the de-energized position. For this purpose, a brake disc or a brake lining or another part of the braking device that causes blocking can be pressed against an otherwise movable part, for example the rotary housing, by means of a spring element or another element generating a force.

In the resting and/or starting position, the foil device is preferably aligned at least approximately identically to the operating position. A relative movement of the foil device then results in influences on the movement of the floating body that are as constant as possible. Alternatively, however, the uplift and/or the water resistance exerted by the foils is reduced in the resting and/or operating position, e.g., due to a slightly different angular position of the foils. In this way, an influence on the movement of the floating body by the foil device is kept as small as possible in the resting and/or starting position.

The drive of the retaining device is preferably arranged at least partially, in particular completely, in a cutout in the floating body. In particular, the drive has a surface, or a cover having a surface, which fits into the surface of the floating body. However, the surface is arranged in particular on the underside of the floating body. Due to this arrangement of the drive, the water sport device is streamline-optimized and even more compact and can be operated accordingly with less resistance and in shallower water.

Particularly preferably, the retaining device has at least one further link. In particular, the first link and the further link are arranged one behind the other in the direction of travel at least in the operating position of the foil device. Alternatively or additionally, the first link and/or the second link is/are pivotably arranged in particular on the floating body and/or on the foil device or a unit or receptacle rigidly connected thereto. In particular, at least one of the links is thus pivotably arranged on a receptacle for the at least one foil device or a receptacle of the foil device. The pivot axes are here in particular aligned transversely to the direction of travel and, during operation, parallel to the water surface. As a result, the retaining device can be designed as a parallelogram guide, which is particularly reliable and causes the carrying device to remain below the floating body, in particular also in the resting and/or starting position.

Alternatively or additionally, the retaining device preferably comprises further links, which are each coupled to one of the two links and connect to one another at least in the operating position between the floating body and the foil device and transmit force to one another. In particular, the two first or further links are pivotable relative to one another, as a result of which a toggle lever or folding mechanism can be produced as the retaining device. For example, in each case two links forming a knee joint are arranged one behind the other in the direction of travel.

Alternatively or additionally, at least one of the two links is displaceable at least at one end relative to the floating body or relative to the foil device. Thereby it is possible to form a scissors mechanism for transitioning the foil device. Alternatively or additionally, at least one of the links is mounted so that it is pivotable relative to the floating body and/or relative to the foil device about a pivot axis that is parallel to the direction of travel. In particular, the retaining device comprises a total of at least four links, which are coupled to one another in the manner of a scissor jack (the links located opposite one another are in any case arranged in parallel). The above-described mechanical features of the retaining device or the links make it possible to provide particularly reliably manageable transition mechanisms and thus water sport devices.

As an alternative or in addition, the foil device has telescoping links that are mounted so as to be longitudinally displaceable into or along one another and via which the distance between the foil device and the floating body can be varied.

In an advantageous configuration of the invention, the water sport device has at least one depth and/or proximity sensor, which is connected to a control unit designed for controlling the drive. The sensor is designed in particular to measure an immersion depth of the water sport device or of an integral part thereof and/or to measure a distance of the water sport device to the bottom (of the body of water). Alternatively or additionally, the sensor or one of the sensors is designed to measure a distance of the water sport device from an obstacle, in particular from any further water sport devices, preferably in the direction of travel. The drive is designed in particular in such a way that, depending on the sensor data, in particular during the movement of the water sport device, the distance of the foil device from the floating body is preferably varied during the ride, in particular the foil device is at least partially transitioned into the operating position or the resting and/or starting position. As a result, damage to the water sport device due to coming into contact with the bottom, particularly near the beach or shore, and unintentional operating situations, such as a floating body having too far a distance from the surface of the water, can be avoided, and the user is assisted in operating the water sport device. The foil device is preferably extended automatically and/or after release by the user after a start near the shore or near the beach if there is sufficient water depth, and then retracted accordingly on returning.

The sensor is arranged in particular on the foil device or the receptacle or the floating body. The sensor preferably has at least one ultrasonic transducer. This makes it possible to ascertain separations or distances particularly reliably under water.

The at least one foil device preferably has at least two wing-type foils. These extend, in particular viewed in the direction of travel, to the left and right proceeding from a central vertical axis or from a vertical center plane extending in the direction of travel. In particular, the two foils are mirror-symmetric to the vertical plane. Particularly preferably, one or at least one of the foils is at least approximately delta-shaped when viewed from the top. A delta-shaped configuration means a substantially triangular shape, with one of the three corners pointing in the direction of travel. The lateral flanks are here in particular bulbous. This design of the foil device means that it has a particularly low flow resistance and makes possible the greatest possible uplift.

The water sport device preferably comprises a fastening means such as an eyelet placed on the floating body. In particular, a sensor provided for picking up tensile forces is assigned to the fastening means. Thereby, the water sport device can be coupled to other watercraft and the introduction of force can be monitored in this way.

In an advantageous configuration of the invention, the water sport device has a propulsion device provided for its propulsion. The propulsion device is at least partially formed as part of the foil device or is at least partially arranged between the retaining device and the foil device or on parts of the retaining device intended to only remain in the water. A particularly stable position of the water sport device is achieved by the propulsion device being in the immediate vicinity of the foils. In particular, the arrangement of the propulsion device avoids the propulsion breaking off when the floating body lifts off the water surface. The propulsion device comprises at least one propulsion element designed as an impeller or propeller, through which great propulsion can be achieved with only low flow resistances and a low susceptibility to errors. The propulsion element is driven by a propulsion motor, which is designed in particular as an internal rotor motor, through which a flow channel extends. This is accompanied by a compact design of the propulsion device.

In order to control the drive and/or the propulsion device, the water sport device has a control unit which is connected in particular to the depth and/or proximity sensor. The control unit comprises the usual means for carrying out the control, e.g., comprising EDP means, interfaces to the drive and/or the propulsion device, to the energy store, etc. In particular, the individual components communicate via a BUS system, which connects motor controllers of the drive and/or of the propulsion device, energy storage management, and/or a human-machine interface to one another. The control unit is arranged in particular with the EDP means in the floating body, but it is also arranged in particular with the communication means distributed over the water sport device.

In particular, the impeller or propeller is arranged in a flow channel of a propulsion body. The flow channel is connected to the environment via at least two openings, preferably an inlet opening and an outlet opening. One of the openings is preferably formed by a laterally protruding housing wall of the propulsion body. In particular, the propulsion device is elongate substantially in the direction of travel, with a substantially round cross section. The inlet opening is here preferably arranged in the shape of a ring between two adjacent propulsion body sections of different diameters.

The impeller is particularly preferably designed as an impeller without a shaft or hub. As a result, the flow cross section in the propulsion body is increased compared to similar-sized impellers having a shaft or hub. In addition, the flow in the propulsion body is not impeded by a shaft or hub. In combination with an internal rotor motor, through which the flow channel extends, a particularly compact and injury-resistant design of the water sport device is created.

The water sport device, in particular the propulsion device, preferably comprises at least one sensor, preferably a plurality of sensors, from a group comprising gyro sensors, speed sensors, position sensors (GPS, Glonass, BeiDou or the like), distance sensors, i.e., sensors for measuring the distance from objects or structures (especially ultrasound, echo sounding, sonar), infrared sensors, and inclination sensors. Here, the group of sensors likewise comprises the aforementioned proximity and depth sensors. Equipping the water sport device with one or more such sensors enables the formation of an "intelligent" water sport device, which not only makes its use more trackable by storing the sensor data in a corresponding memory, but in particular makes it more convenient, simpler, and safer. For example, it is possible to use a position sensor for tracking the route, a speed sensor for adjusting the retaining device and/or at least parts of the foil device, inclination sensors for balancing the water sport device in an operating position, and infrared sensors for detecting people located in the environment. Depending on the sensor data, the water sport device can automatically make adjustments, e.g., to the travel speed, the height above the water surface, or the position of the retaining device. The control unit is designed to process the signals from the sensors, in particular to form control signals, for one or more of these processes. It goes without saying that the control unit also has corresponding data processing means, propulsion energy stores (in particular one or more batteries or liquid energy stores), and communication means including a human-machine interface, for this purpose.

According to an advantageous embodiment of the invention, for the purpose of geofencing, the control unit is designed to generate control signals on the basis of signals from the at least one sensor. Geofencing means restricting the region that can be navigated by the water sport device on the basis of navigation data. If it is ascertained in the control unit based on data for example from a position sensor that a specifiable region has been left or is about to be left, for example the drive power of a propulsion device can be reduced or the foil device can be transitioned into a resting and/or starting position.

The safety and comfort of a water sport device according to the invention are further enhanced if it has a propulsion energy store for the propulsion device and a storage sensor for monitoring the propulsion energy store, wherein the water sport device is designed to reduce the power or switch off the propulsion device based on the signal from the storage sensor by means of the control unit.

The propulsion device and the control unit are preferably designed for in particular automatic thrust control, further in particular for automatic thrust vector control. As a result, an additional control option is made available to a user, such that, for example, particularly tight curves can be negotiated or even jumps can be made. In an automated configuration, active self-stabilization of the water sport device occurs, in particular in the operating position, in particular in connection with position sensors such as gyrometers. In the case of active self-stabilization, the control unit thus compensates for instabilities by sending control commands to at least one actuator of the water sport device, wherein actuators are active actuating elements. This can be a motor of the propulsion device, adjustable flaps or nozzles, or adjustable fins, rudders, foils, or individual adjustable portions thereof. In the control unit, input variables such as data on the position of the water sport device, power of the propulsion device, speed, acceleration, and/or user inputs are evaluated and control commands for one or more actuators are generated. As a result, it is possible for beginners in particular to more rapidly have a better riding experience. In particular, the control unit is designed for active self-stabilization of the water sport device by means of thrust vector control during the transition into the operating position and/or when the floating body lifts off from the water surface, since the user is subjected to great influences during these phases.

Preferably, the water sport device comprises a propulsion device which is provided for the propulsion thereof and whose propulsion motor, which is arranged on the floating body side, is connected in terms of drive to a propulsion element via an angularly movable propulsion train. Due to the arrangement of the propulsion motor in the floating body, the foil device can be built to be narrower and in particular more streamlined.

The propulsion device preferably comprises a pivotable propeller, at least one pivotable guide vane and/or a plurality of nozzles that are pivotable in different directions, so that the foil device and/or retaining device and thus the water sport device can be aligned by means of the propulsion device.

There is also a gain in terms of comfort, in particular if a number of people use the same water sport device, when a number of selectable travel profiles are stored in the control unit. For example, the travel profile can comprise a specifiable maximum speed, a height above the water, or a maximum distance from a site of use or base.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Individual technical features of the exemplary embodiments described below can also lead to refinements according to the invention when combined with the features of the independent claim. Where expedient, functionally identical parts are denoted by identical reference signs.

Figure 1:
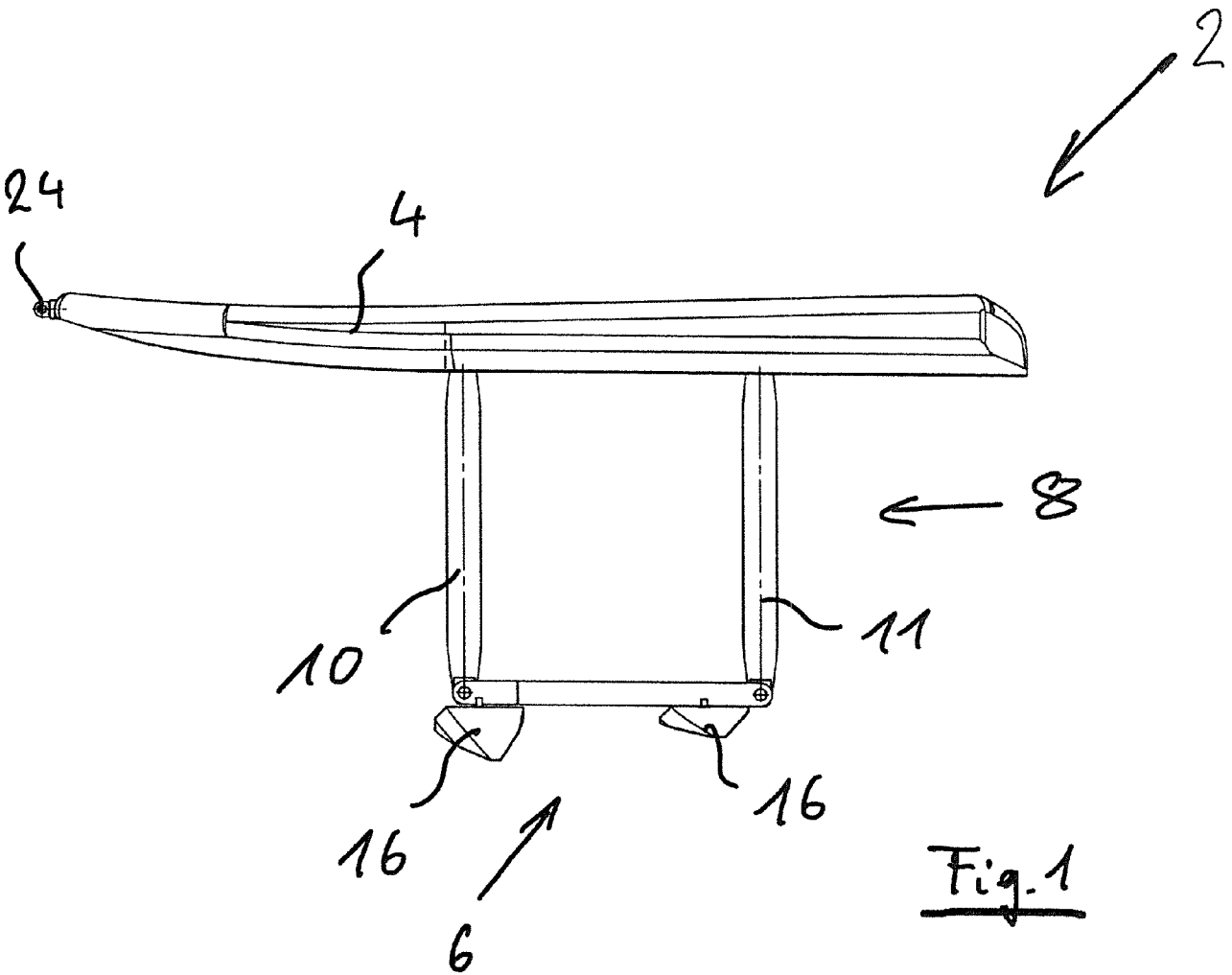
FIG. 1 shows the subject matter according to the invention in a side view

A water sport device 2 has a floating body 4 designed as a floating board in the form of a surfboard. The water sport device can be pulled over a front fastening means 24 in the form of an eyelet. A foil device 6 is attached to the floating body by means of a retaining device 8. The retaining device 8 has a front link 10 and a rear link 11, via which the foil device 6 is fastened to the floating body 4 with its two foils 16. The foil device can be transitioned from the operating position shown in FIG. 1, in which the foil device 6 is spaced apart from the floating body 4, into a rearward position (FIG. 2), in which the foil device is closer to the floating body 4, by means of a drive 12 shown schematically in FIG. 2. This is an intermediate position on the way to the resting and operating position shown in FIG. 3, in which the foil device 6 is arranged close to the floating body.

Figure 2:
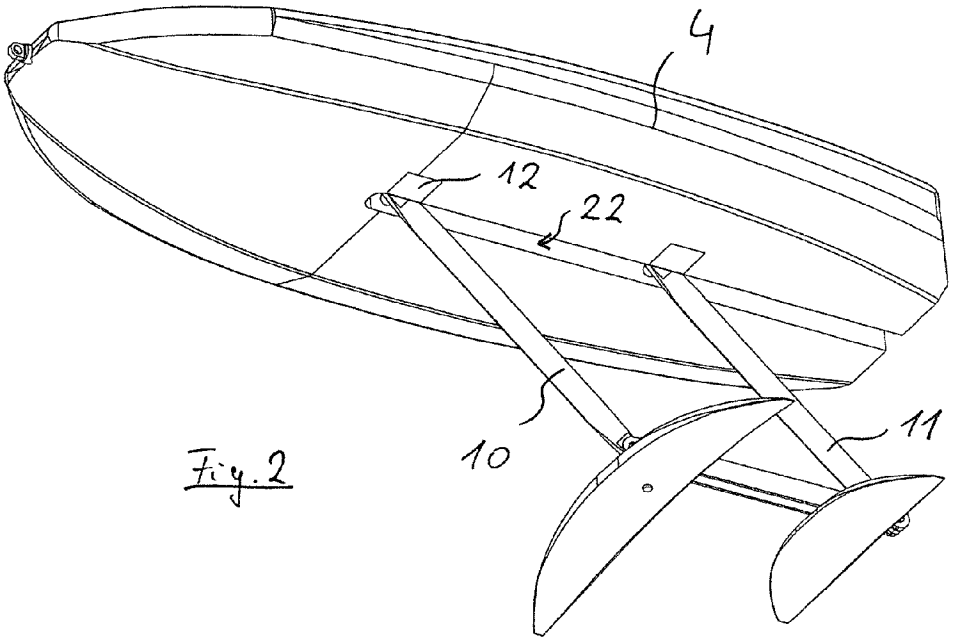
FIG. 2 shows the subject matter according to FIG. 1 in a perspective view from the bottom and a further operating position.
Figure 3:
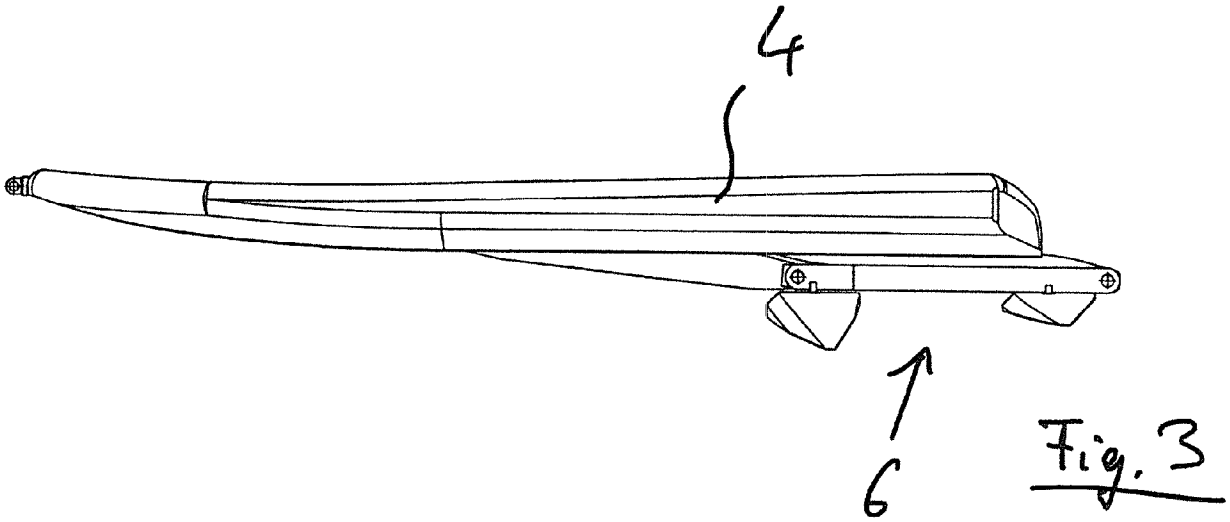
FIG. 3 shows the subject matter according to FIG. 1 in a resting and/or starting position.
Figure 4A:
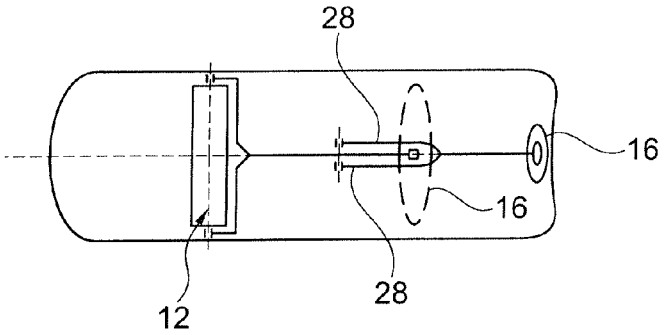
FIG. 4*a* shows a schematic illustration of the construction of the subject matter according to the invention in a plan view.
Figure 4B:
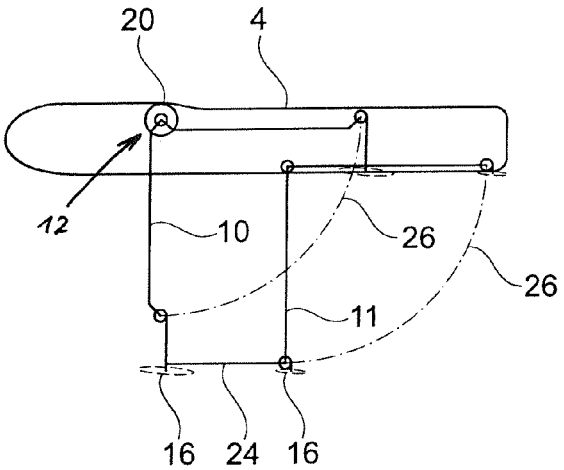
FIG. 4*b* shows the subject matter according to 4*a* in a side view and a further position.

The drive 12, which is partially shown in FIG. 2, can have, according to FIGS. 4*a* and 4*b*, an outer shaft with which an electric motor engages, which is arranged in a cylindrical housing 20 and on which a can be retracted into a floating body cutout 22 (not shown in more detail in FIG. 2) (cf. FIG. 2). Due to the cutout in the floating body, which can also be present in other exemplary embodiments of the invention, the foil device can pivot with its foils 16 close to the floating body 4. The links 10 and 11 of the retaining device are coupled to one another by a transverse linkage 24, resulting in the forced guidance shown by means of the circular arcs 26 describing the pivoting angle.

While the front link 10 is constructed in one piece, the rear link 11 is branched according to the illustrated embodiment and designed in the shape of a tuning fork, so that the front link 10 can pivot through the two parallel link sections 28 during the pivoting process. As a result, the link 10 is accommodated in the floating body 4.

Figure 5:
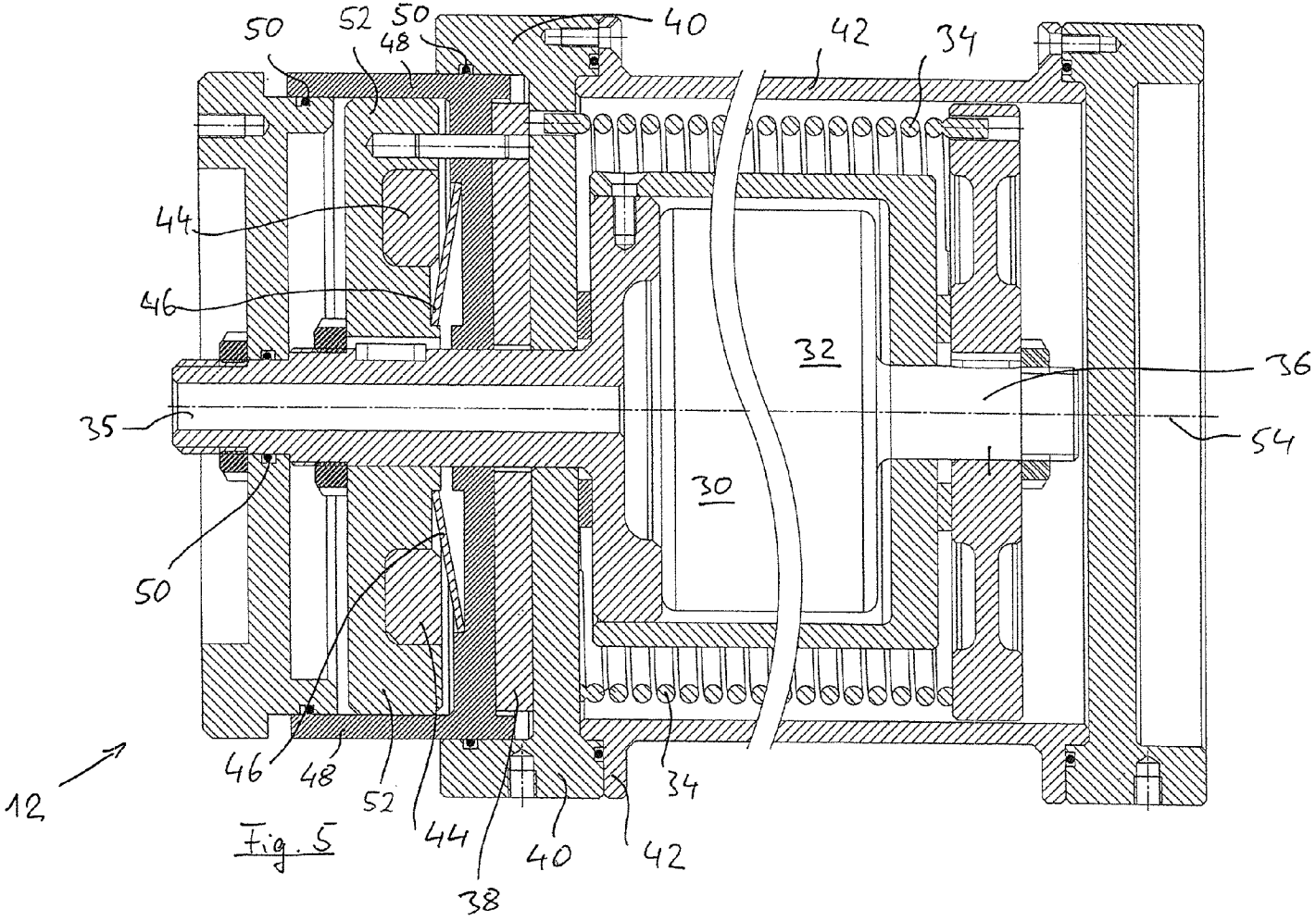
FIG. 5 shows a schematic, partially broken construction of the drive.

An exemplary construction of a drive 12 is provided without the associated control unit with an electric motor 30, which is supplied with power by an energy store (also not shown) and whose motor shaft is on a gearing 32 arranged directly on the motor (FIG. 5). The motor is supplied via a supply line. The gearing 32, which is designed as a step-up gearing, is used to transmit a correspondingly large force to a mechanical energy store, which has a spring 34 designed as a torsion spring. In the present case, the force is transmitted via a shaft 36, on which a holder for the torsion spring 34 is arranged in a rotationally fixed manner. The torsion spring 34 is loaded against a rotary housing flange 40, which is releasably held in place by a brake disc 38 of an electromagnetically actuable braking device and which in turn is connected to the further hollow-cylindrical rotary housing 42. The latter can pivot about an axis 54. For example, a link 10 of the retaining device 8 can be fastened directly to the rotary housing 42. In the blocking position of the retaining device 8, the brake disc 38, which is firmly attached to a brake disc mount 48, is pressed against a rotary housing flange 40 by a spring element, preferably in the form of a disc spring 46, which is supported on the magnet mount 52, so that said flange cannot pivot about the axis 54 with the attached rotary housing 42. Actuation of the at least one electromagnet 44 in the form of an application of current leads to the generation of an attractive force and causes the brake disc 38 to be pulled away from the rotary housing flange 40. This releases the rotary housing 42, and the energy stored in the mechanical energy store causes the rotary housing to pivot about the axis 54. The speed at which the rotary housing 42 rotates or pivots can be adjusted by precisely setting the braking force, which can be varied by the electromagnet 44. When the attractive force is reduced and the electromagnet 44 is switched off, the disc spring 46 pushes the brake disc 38 with the brake disc mount 48 back in the direction of the rotary housing flange 40, which brakes it and thus the rotary housing 42 again until it comes to a standstill.

The internal brake disc 38 and the region of the electromagnet or electromagnets 44 with the associated magnet mount 52 are sealed off from the environment by means of seals 50. The entire device is particularly compact due to the integration of the electric motor in the energy store when the energy store is designed with a spring element, wherein the drive 12 is designed to be secure so that if the electromagnet is de-energized and switched off as a result, a movement of the links 10 fastened to the rotary housing 42 is automatically blocked and thus prevented.

The invention claimed is:

1. A water sport device comprising:

a floating body;

a foil device;

a retaining device fastening the floating body to the foil device, wherein the retaining device has a drive via which the foil device can be transitioned from a resting and/or starting position into the operating position and/or from the operating position into the resting and/or starting position;

wherein the foil device, which is arranged on a link of the retaining device, has one or more foils and can be transitioned from a resting and/or starting position into an operating position below the floating body via the retaining device, wherein, in the operating position and during a forward movement, the floating body can be transitioned into a position in which it is separated from the water surface due to uplift generated by the foil device, wherein the drive has an energy store, and wherein the energy store has at least one spring and can be preloaded by means of a motor.

2. The water sport device as claimed in claim 1, wherein the drive has a gearing via which the motor of the drive is connected to the energy store.

3. The water sport device as claimed in claim 1, wherein at least in the actuated state, the spring is connected to the link of the retaining device in such a way that its force can be used at least partially to align the link.

4. The water sport device as claimed in claim 1, wherein the energy store can be preloaded in opposite directions by the motor and/or gearing.

5. The water sport device as claimed in claim 4, wherein the energy store has two springs that can be loaded.

6. A water sport device comprising:

a floating body;

a foil device;

a retaining device fastening the floating body to the foil device, wherein the retaining device has a drive via which the foil device can be transitioned from a resting and/or starting position into the operating position and/or from the operating position into the resting and/or starting position;

wherein the foil device, which is arranged on a link of the retaining device, has one or more foils and can be transitioned from a resting and/or starting position into an operating position below the floating body via the retaining device, wherein, in the operating position and during a forward movement, the floating body can be transitioned into a position in which it is separated from the water surface due to uplift generated by the foil device;

wherein the retaining device has a braking device which releases and/or brakes the displacement of the foil device.

7. The water sport device as claimed in claim 6, wherein the braking force is settable depending on the speed of the floating body.

8. The water sport device as claimed in claim 1, wherein the drive of the retaining device is arranged completely in a cutout in the floating body.

9. The water sport device as claimed in claim 1, wherein the retaining device has a further link which is pivotably mounted on or in the floating body at one end and pivotably arranged on the foil device at the other end.

10. The water sport device as claimed in claim 1, wherein one of at least three links is forcibly guided.

11. A water sport device comprising:

a floating body;

a foil device;

a retaining device fastening the floating body to the foil device, wherein the retaining device has a drive via which the foil device can be transitioned from a resting and/or starting position into the operating position and/or from the operating position into the resting and/or starting position;

wherein the foil device, which is arranged on a link of the retaining device, has one or more foils and can be transitioned from a resting and/or starting position into an operating position below the floating body via the retaining device, wherein, in the operating position and during a forward movement, the floating body can be transitioned into a position in which it is separated from the water surface due to uplift generated by the foil device;

wherein the drive has an energy store;

wherein the energy store has at least one spring and can be preloaded by means of a motor;

wherein the drive has a gearing via which the motor of the drive is connected to the energy store;

wherein the motor, gearing, energy store, and/or a braking device are designed coaxially.

12. The water sport device as claimed in claim 1, further including a propulsion device provided for the propulsion of the water sport device.

13. The water sport device as claimed in claim 12, wherein the propulsion device comprises at least one propulsion element designed as an impeller or propeller.

14. The water sport device as claimed in claim 1, further including at least one control unit designed to control the drive and/or the propulsion device.

15. A water sport device comprising:

a floating body;

a foil device;

a retaining device fastening the floating body to the foil device, wherein the retaining device has a drive via which the foil device can be transitioned from a resting and/or starting position into the operating position and/or from the operating position into the resting and/or starting position;

at least one control unit designed to control the drive and/or the propulsion device;

wherein the foil device, which is arranged on a link of the retaining device, has one or more foils and can be transitioned from a resting and/or starting position into an operating position below the floating body via the retaining device, wherein, in the operating position and during a forward movement, the floating body can be transitioned into a position in which it is separated from the water surface due to uplift generated by the foil device;

wherein the water sport device has at least one sensor from a group comprising gyro sensors, speed sensors, position sensors, distance sensors, infrared sensors, proximity sensors, depth sensors, and inclination sensors.

16. The water sport device as claimed in claim 15, wherein, for the purpose of geofencing, the control unit is designed to process the signals from the sensors.

17. A water sport device comprising:

a floating body;

a foil device;

a retaining device fastening the floating body to the foil device, wherein the retaining device has a drive via which the foil device can be transitioned from a resting and/or starting position into the operating position and/or from the operating position into the resting and/or starting position;

a propulsion device provided for the propulsion of the water sport device;

a propulsion energy store for the propulsion device, and a storage sensor for monitoring the propulsion energy store, wherein the water sport device is designed to reduce the power or to switch off the propulsion device on the basis of the signal from the storage sensor by means of the control unit;

wherein the foil device, which is arranged on a link of the retaining device, has one or more foils and can be transitioned from a resting and/or starting position into an operating position below the floating body via the retaining device, wherein, in the operating position and during a forward movement, the floating body can be transitioned into a position in which it is separated from the water surface due to uplift generated by the foil device.

18. The water sport device as claimed in claim 14, wherein the control unit is designed for communication with a control unit of a further propulsion device of the same or of a further water sport device.

19. The water sport device as claimed in claim 14, wherein the propulsion device and the control unit are designed for thrust control.

20. The water sport device as claimed in claim 13, further including a propulsion device which is provided for propelling the water sport device and whose propulsion motor, which is arranged on the floating body side, is connected in terms of drive to the propulsion element via an angularly movable propulsion train.

21. The water sport device as claimed in claim 14, wherein the control unit is designed to self-stabilize the water sport device by means of thrust vector control during the transition into the operating position and/or in the operating position.

22. The water sport device as claimed in claim 14, wherein the propulsion device has a pivotable propeller, at least one pivotable guide vane, and/or a plurality of nozzles pivotable in different directions.

23. A water sport device comprising:

a floating body;

a foil device;

a retaining device fastening the floating body to the foil device, wherein the retaining device has a drive via which the foil device can be transitioned from a resting and/or starting position into the operating position and/or from the operating position into the resting and/or starting position;

at least one control unit designed to control the drive and/or the propulsion device;

wherein the foil device, which is arranged on a link of the retaining device, has one or more foils and can be transitioned from a resting and/or starting position into an operating position below the floating body via the retaining device, wherein, in the operating position and during a forward movement, the floating body can be transitioned into a position in which it is separated from the water surface due to uplift generated by the foil device;

wherein a plurality of selectable travel profiles are stored in the control unit.

24. The water sport device as claimed in claim 1, wherein the retaining device is retractable and extendable and/or foldable.

* * * * *